United States Patent [19]

Zoor

[11] 4,128,257

[45] Dec. 5, 1978

[54] SAFETY SKI BINDING FOR CROSS-COUNTRY AND DOWNHILL SKIING

[75] Inventor: Reinhold Zoor, Dachau, Fed. Rep. of Germany

[73] Assignee: Heinrich Wunder KG, Dachau, Fed. Rep. of Germany

[21] Appl. No.: 703,938

[22] Filed: Jul. 9, 1976

[51] Int. Cl.[2] ..... A63C 9/086; A63C 11/12

[52] U.S. Cl. ..... 280/614; 280/618

[58] Field of Search ..... 280/614, 618, 620, 631, 280/617

[56] References Cited

U.S. PATENT DOCUMENTS

| | | | |
|---|---|---|---|
| 3,781,028 | 12/1973 | Gertsch | 280/618 |
| 3,801,119 | 4/1974 | Andre | 280/618 |
| 3,877,712 | 4/1975 | Weckeiser | 280/614 |
| 3,908,971 | 9/1975 | Engel | 280/614 |
| 3,944,237 | 3/1976 | Teague | 280/618 |
| 3,958,811 | 5/1976 | Sittmann | 280/618 |

FOREIGN PATENT DOCUMENTS

| | | | |
|---|---|---|---|
| 1728485 | 7/1973 | Fed. Rep. of Germany | 280/614 |
| 2209621 | 9/1973 | Fed. Rep. of Germany | 280/614 |
| 844838 | 8/1939 | France | 280/618 |
| 1340309 | 9/1963 | France | 280/614 |
| 2231402 | 12/1974 | France | 280/614 |
| 412672 | 11/1966 | Switzerland | 280/620 |

*Primary Examiner*—David M. Mitchell
*Attorney, Agent, or Firm*—Michael J. Striker

[57] ABSTRACT

A safety ski binding for cross-country and downhill skiing comprises a support plate which is pivoted at its front end on the ski and on which is provided a longitudinally slidable release plate. This plate is formed with a slot through which engages a pin in the support plate so as to permit this release plate to slide longitudinally and pivot on the ski. The front end of the release plate fits under a holddown and is provided itself with a toe holder. A spring-loaded heel clamp is engageable with the heel of a skiboot at the rear end of the support plate and presses the skiboot into the toe clamp. The rear end of the support plate can be locked down onto the ski for downhill skiing or released for pivoting of the support plate for cross-country skiing.

2 Claims, 4 Drawing Figures

SAFETY SKI BINDING FOR CROSS-COUNTRY AND DOWNHILL SKIING

BACKGROUND OF THE INVENTION

The present invention relates to a ski binding. More particularly this invention concerns a safety ski binding for use both in cross-country skiing or in downhill skiing.

The main difference between the equipment used for cross-country skiing and for downhill skiing is in the bindings. For downhill skiing the skiboot is secured both at the toe and at the heel to the ski. On the contrary for cross-country skiing a walking maneuver must be possible so that the skiboot or the equivalent must be able to pivot on the ski about an axis which is perpendicular to the normal direction of travel of the ski and generally at the toe of the boot.

Double-duty ski bindings are known which can allow the skiboot to be secured at the toe and heel as for downhill skiing and can also allow it to pivot as for cross-country skiing (also known as touring skiing). Usually such a ski binding is also provided with means that release the skiboot when this boot stresses the toe or heel holders with greater than a predetermined force. Thus injury is avoided, as the skier's foot is freed from the ski in case of a spill.

A typical such double-duty ski binding has a plate which is hinged at its front end on the ski and which can be rigidly secured at its rear end to the ski. This plate carries conventional toe and heel holders, that is, clamps which engage over the toe and heel portions of the boot sole to secure this boot securely to the plate. Such an arrangement is relatively simple and uses conventional items. However it has the considerable disadvantage that the toe of the skiboot must be spaced relatively far from the hinge in order to accommodate between this toe and the hinge the relatively long toe holder. Thus during cross-country use the skier must pivot his skiboot about an axis relatively far from the tip of the ski, an extremely strenuous and tiring manner of skiing. Furthermore when the boot is so raised from the ski the likelihood of a spill is considerably increased.

Since much cross-country skiing is done in a camping context when the skier does not want to be burdened with skiboots only suitable for skiing, it is important to be able to use cross-country ski bindings with conventional heavy-duty hiking shoes. This is normally made possible by securing to such hiking shoes intermediate plates which are in turn fitted to the double-duty binding. Such an arrangement has the disadvantage of considerable extra cost and also elevates the boot relatively far from the ski, thereby increasing the difficulty of skiing.

Another difficulty with most of the known safety bindings is that the type of boot used changes the release force of the binding. This is mainly due to the fact that frictional forces between the boot and a surface of the binding frequently are a considerable factor in the force at which the binding releases so that relatively rough boots will release at a greater force and relatively smooth boots at a lesser force.

Double-duty ski bindings can be seen in German published specification No. 1,578,912 and in German patent specification open for inspection No. 2,213,354.

SUMMARY OF THE INVENTION

It is therefore an object of the present invention to provide an improved safety ski binding.

Another object is the provision of a double-duty safety ski binding usable both for cross-country skiing and downhill skiing.

Yet another object is the provision of such a binding which has a relatively low height so that the boot is spaced as closely as possible to the upper surface of the ski.

Yet another object is to provide such a binding which minimizes the effort required for cross-country skiing.

Another object of the present invention is the provision of a ski binding which can be used with virtually any type of boot and whose release characteristic does not depend on the materials the boot is made of.

These objects are attained according to the present invention in a safety ski binding comprising means on a ski defining a primary pivot axis extending generally perpendicular to the normal direction of displacement of the ski, a support secured to this means and pivotal about the primary axis, a plate mounted on the support and displaceable thereon, a toe holder carried on the plate and adapted to engage over and around the toe of a boot, a heel holder aligned on the ski behind the toe holder and adapted to engage over and around the heel of the boot, and means connected to one of the holders for displacement of the plate on the support and freeing of the boot from between the holders on stressing of at least one of the holders in a predetermined direction with greater than a predetermined force.

Such a release plate which only carries simple toe and heel holders can be relatively flat so that the boot will virtually rest on the top surface of the ski. In accordance with the present invention one of these holders, the heel holder preferably, is provided with the spring-loaded means that allow it to move relative to the other holder so that the boot can be released when the predetermined force is exceeded.

It is possible in accordance with this invention to fix the toe and heel holders on the release plate and then to hold the release plate down on the support by means of a spring-loaded cable or the like. The term toe or heel holder as used here comprises any element, even of magnetic operation, which can be used to secure the toe or heel of a skiboot or the like in place on the ski.

According to another feature of this invention the toe holder is formed as a relatively rigid bow which overreaches the toe portion of the boot sole and holds it down on the ski. Alternatively a rigid block can be used which is cut to fit over the skiboot sole. In both cases the relatively simple structure of the toe holder greatly minimizes the overall length of the assembly so that the cross-country pivot or primary axis can be relatively close to the toe of the skiboot.

According to further features of this invention the plate is pivotal on the support about a secondary axis lying in a plane perpendicular to the primary axis and parallel to the normal direction of travel of the ski. In addition this plate is displaceable on the support limitedly in the normal direction of travel of the ski in order to allow disengagement of the boot from the binding. The heel holder is provided on the support and means is provided for securing this support flatly on the ski for use in downhill skiing. The heel holder with such an arrangement is spring-loaded and adapted to push the boot forwardly into the toe holder. Thus this single holder at the heel of the boot serves to secure the entire boot in place and allows a release of this boot by backward displacement of the heel holder away from the toe holder. In addition such a system has the considerable advantage that the release plate can be relatively thin. Since it is held between the skiboot and the ski it cannot be deformed, and it need merely be strong enough to transmit the force in the direction of travel of the ski from the heel to the toe. Such a plate is made in accordance with this invention of relatively springy material, an elastically bendable stainless-steel plate or syntheticresin being ideal. In particular the plate can be made of a relatively smooth and elastically bendable synthetic-resin material, or strips of such material can be provided on the pivotal support in order to facilitate lateral sliding of the plate on the support.

According to other features of this invention there is provided on the binding a stand plate for the boot. This plate is limitedly displaceable parallel to the direction of travel so as to minimize frictional forces between the boot and the binding. Thus the material of which the boot sole is made does not have any effect on the functioning of the binding, as the static friction between the stand plate and the rest of the binding is the same for all types of boot. Such a stand plate is urged forwardly by a relatively weak spring in accordance with this invention.

According to another feature of this invention the support is formed by a plate that underlies the release plate. One of these plates is formed with a slot extending in the direction of travel of the ski and the other is provided with a pin that fits in the slot and constitutes the pivot forming the secondary pivot axis. According to this invention the pin is provided on the support plate and the slot on the release plate. In addition the front end of the release plate is forwardly convex and is received in a backwardly concave seat formed on the support plate. This seat may be formed to closely fit against and slightly overreach the front edge of the release plate, or can be formed simply by two rollers or pins between which the forwardly convex front edge of the release plate rests. According to other features of this invention the seat may be non-symmetrical relative to a plane extending in normal direction of travel of the ski so that the force needed to swing the toe of the boot out of the binding in one lateral direction is different from that in the other lateral direction. In any case means is provided for minimizing the frictional contact between the plate and the seat so that, once again, extraneous factors will not effect the setting of the binding.

In order to prevent the release plate from simply swinging free when the binding is not mounted on a boot, as when the skis are being transported to the skiing location on top of a car, in accordance with this invention there is provided a retainer that lightly holds the release plate in place. This is constituted in accordance with this invention by a bump formed in the slot in which the pin carried on the plate slides. Such a bump is dimensioned so as not to interfere with sliding of the release plate when pushed backward or forward by the boot, but is sufficient to prevent the release plate from simply swinging free when unloaded.

According to yet another feature of this invention the toe holder is provided with a backwardly turned surface that engages against the skiboot and which is inclined upwardly relative to the upper surface of the ski. This allows the toe of the boot to slip upwardly out of the toe holder in case, for instance, of a backward fall on the part of the skier.

According to further features of this invention the ski binding is provided in order to accommodate various different sizes of boots with a heel holder mounted on a support which is slidable along the ski and which serves to lock the support plate down for use of the binding in downhill skiing. This arrangement is provided also with the above-mentioned slidable stand plate.

According to yet another feature of this invention the heel clamp or holder is formed as a U-shaped element having two arms and a bight portion. The arms are pivoted at their free ends about a third axis parallel to the primary axis and a holding member is pivoted on the bight portion about a forth axis parallel to this axis. The arms of the U-shaped holder element are extensible and are provided with a spring which resists their extension, so that these springs constitute the resilient part of the boot-holding arrangement. The angular position of the clamping member relative to the boot, as determined by a set screw, determines the amount of force which the springs exert on the boot and, through the boot, on the toe holder. Indicia on the arms of the bow supporting the heel clamp indicating the relative positions of the two parts constituting each arm show just how much force is being exerted and allow reproducible settings of the ski binding to be obtained.

Thus, the ski binding according to the present invention is a relatively light and inexpensive item. It can readily be used both for standard downhill skiing or for cross-country skiing. Furthermore it can be adjusted with relative ease even by an amateur and can be used with virtually any type of skiboot or hiking boot.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
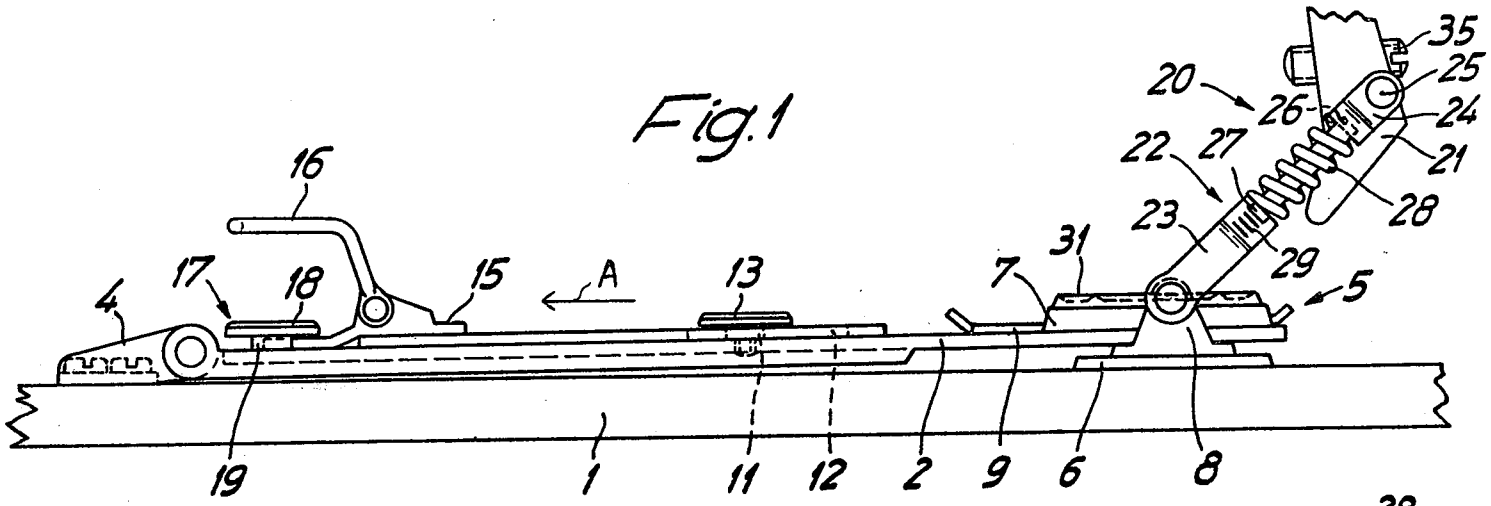
FIG. 1 is a side view of the double-duty safety ski binding according to this invention.
Figure 2:
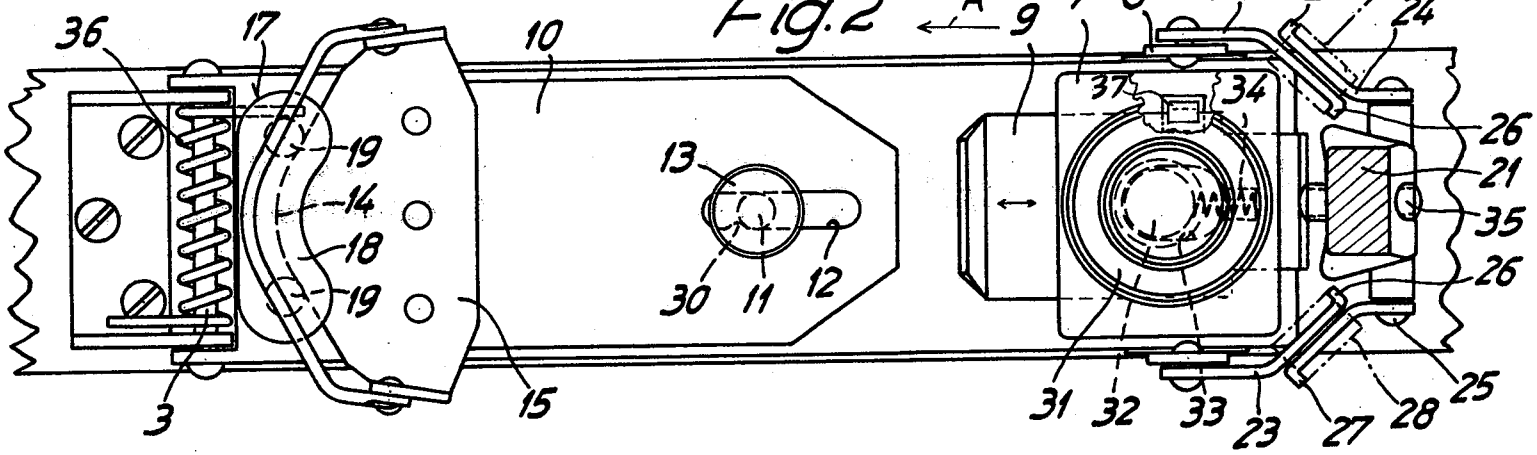
FIG. 2 is a top view partly in section of the binding of FIG. 1.

As shown in FIGS. 1 and 2 a ski 1, normally displaced in a horizontal direction A, is provided with a support plate 2 pivotal about a horizontal axle 3 mounted in a pivot clamp 4. The rear end of the plate 2, relative to the direction A, can be clamped down onto the ski 1 by means of a latch arrangement 5 which is formed by a plate 6 displaceable along the ski and an upper portion 7 which can be secured to the plate 6 as well as to a holding member 8 which is screwed to the member 7. The upper portion 7 is fixed to the lower portion 6 by a slider 9 which is divided lengthwise into regions of different widths and which engages with its thickest portion in a locked-down condition of the plate 2 under holding tabs 37 on the lower portion 6. These tabs extend upwardly through the element 8 and through the plate 2 and when the slider 9 is slid into one end position it engages under their overturned ends and locks the plate 2 down onto the element 6 with the element 8 sandwiched between them. The elements 7, 8 and 2 are permanently interconnected.

A release plate 10 lies on top of the support plate 2 and is made of stiff synthetic-resin material which is resiliently bendable. This plate 10 is formed with a slot 12 elongated in the direction A and accommodating a pin 11 having a large head 13. Thus this pin 11 constitutes a vertical pivot axis for the plate 10 on the plate 2 and the head 13 prevents the plate 10 from coming loose from the plate 2. The slot 12 is formed with a bump 30 which weakly inhibits sliding of the plate 10 backwardly opposite the direction A so as to prevent the plate 10 from coming loose during transport of the skis. The plate 10 is riveted at its front end to a metal nosepiece 15 having a forwardly convex front surface 14 received in a backwardly convex seat constituted by a pair of synthetic-resin rollers and rivets 19 that are seated in the plate 1. Over top of these rivets 19 a hold-down plate or element 18 is provided which overreaches the front edge 14 of the element 15. In addition a bow 16 can fit over the toe end of the sole of a skiboot. The parts 15, 16, 18 and 19 therefore constitute a relatively simple toe clamp that allows the tip of the skiboot toe virtually to lie at the pivot axis 3.

A heel clamp 20 is formed by a U-shaped member 22 on whose bight portion 25 is carried a heel clamp 21. Each leg of the U-shaped yoke 22 which is pivotal about an axis parallel to the axis 3 is formed by a pair of members 23 and 24 having bent over ends 26 and 27 between which are engaged compression springs 28. These compression springs tend to shorten the arms constituted by the elements 23 and 24 so as to pull the clamping member down toward its pivot axis. In addition this clamping member is provided with a set screw 35 that establishes its angle of purchase on the heel of a skiboot sole so as to establish the amount of compression of the springs 28 which can be read off indicia 29. Such an arrangement makes it very easy to set the ski binding, as the angular position of the clamp 21 established by the screw 35 is what determines the force that must be exerted on one of the holders 20 or 17 in order to release the skiboot.

On top of the upper element 7 there is provided a stand plate 31 having a downwardly extending T-head pin 32 engaging in a slot 33 in the element 7. A relatively weak spring 34 presses the stand plate 31 forwardly so that when unstressed this plate lies in the illustrated position, but can readily be pushed backwardly against the force of the spring 34.

In use the skier sets the slider 9 according to whether he wants the sole plate 2 to be locked down on the ski or to be freely pivotal about the axis 3. It is noted in this regard that a coil spring 36 normally holds the plate 2 down against the ski 1. The skier then places his toe under the bow 16 and brings his heel down onto the stand plate 31. The clamp member 21 is now pulled up over the back of the skiboot heel so as to pull it downwardly onto the plate 31. Since, however, in this position the arms 23, 24 are at an angle of approximately 45° to the direction A these springs will not only exert a downward component of force on the skiboot but will also exert a forward component of force so as to press the toe tightly into the bow 16.

Should the skier have a spill, the skiboot will either exert a lateral twisting force at the toe or a lifting force at the heel. The lateral twisting force at the toe will cam the plate 10 back from the rollers 19, simultaneously compressing the springs 28. Once the tip of the surface 14 has passed laterally perpendicular to the direction A beyond the seat formed by the elements 19 the boot will be freed from the binding and the skier will be protected from grave injury. Should the heel lift up as, for instance, during a forward fall the springs will be compressed and the heel will eventually pull out from under the element 21, thereby again completely freeing the boot from the ski.

It can be seen that this binding is a relatively simple machanism which can function both for downhill and cross-country skiing. It is extremely simple to manufacture and can be adjusted with relative ease. Furthermore it adds very little to the overall dimensions of a standard ski binding while functioning perfectly both for downhill and cross-country skiing.

Figure 3:
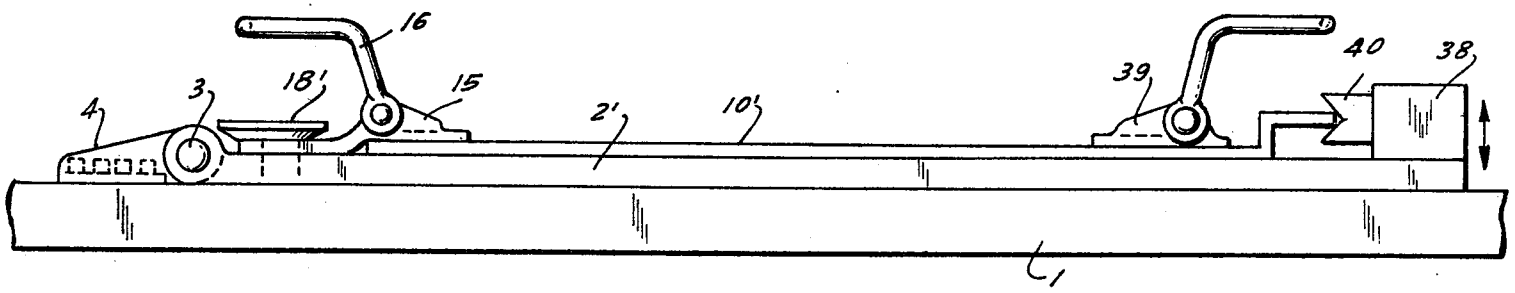
FIGS. 3 and 4 are views similar to FIGS. 1 and 2 of another embodiment of this invention.
Figure 4:
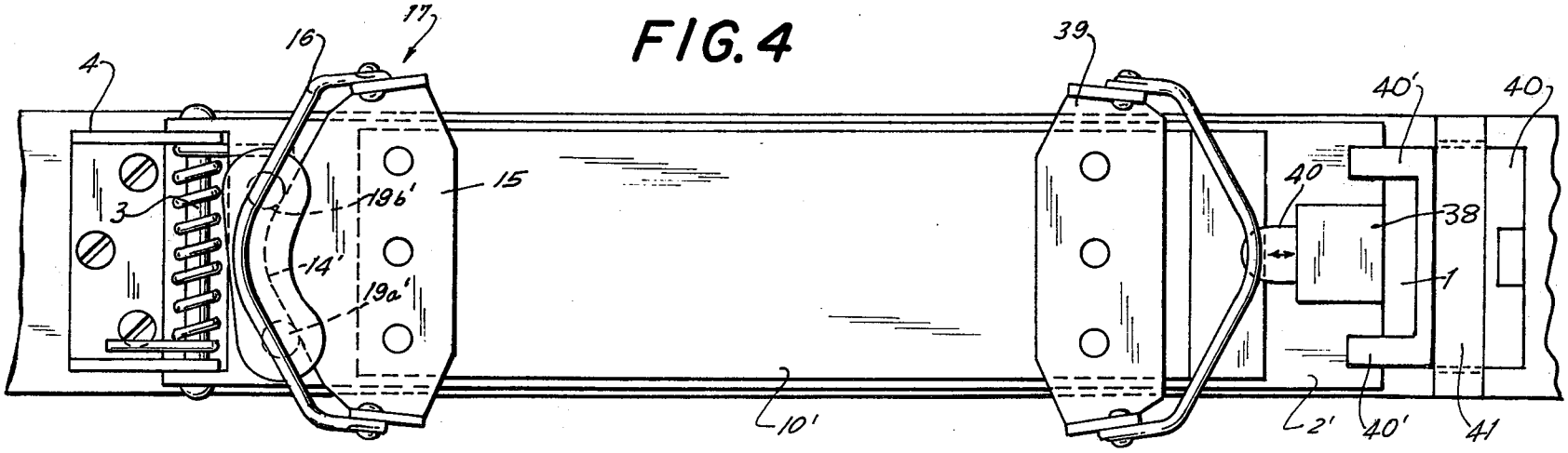

The arrangement shown in FIGS. 3 and 4 is similar to that of FIGS. 1 and 2, with identical reference numerals used for identical structure. Here a heel clamp 39 is provided which is identical to the toe clamp 17 and fixable along the release plate 10' by means not shown. The front end 14' of the plate 10' is nonsymmetrical and is wedged between a pair of rollers or pins **19*a*' and 19*b*' that are similarly nonsymmetrically arranged on the support plate 2'. These pins 19*a*' and 19*b*' have upwardly inclined heads 18' that allow the plate 10' also to slip upwardly past them. The plate 10' can therefore slide more readily to the right, relative to the direction A of travel, than to the left due to the assymetrical positioning of the pins 19*a*' and 19*b*'**, and can also slip up in case the skier falls backward.

The plate 2' whose rear end can be secured to the ski 1 by conventional releasable securing means, is provided at its rear end with a dashpot arrangement 38 which presses forwardly via a spring-loaded pusher 40 against the extreme rear end of the plate 10'. Thus this biasing arrangement 38 presses the front end 14' of the plate 10' into the nonsymmetrical seat formed by the pins **19*a*' and 19*b*'. Any lifting or lateral canting of either end of the plate 10' will push the element 40 in. This action will allow the release plate 10' to come completely free of the plate 2'** and stay on the skiboot.

The conventional releasable securing means, known per se, may include, as schematically shown in FIG. 4, a slider 41 axially guided in a housing 42 fixed to the upper surface of the ski 1 and movable between an active position in which prongs 41' of the slider engage over rear end portions of the support plate 2' and an inactive rearwardly withdrawn position.

It will be understood that each of the elements described above, or two or more together, may also find a useful application in other types of structures differing from the types described above.

While the invention has been illustrated and described as embodied in a double-duty ski binding, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A safety ski binding for securing a skiboot to a ski, said binding comprising:

means on said ski defining a primary pivot axis extending generally perpendicular to the normal direction of displacement of said ski;

a support secured to said means and pivotal about said primary axis;

a release plate mounted on said support and displaceable relative thereto;

a toe holder carried on said plate generally at said primary pivot axis and adapted to engage over and around the toe of said boot;

a heel holder aligned on said ski behind said toe holder relative to said direction and adapted to engage over and around the heel of said boot;

release means connected between one of said holders and said support for displacement of said plate on said support in any position thereof relative to said ski and freeing of said boot from between said holders on stressing of at least one of said holders in a predetermined direction with greater than a predetermined force; and means for releasably securing said support to said ski generally at said heel holder, whereby when thus secured said binding is suitable for downhill skiing and when not secured said binding is suitable for cross-country skiing.

2. The binding defined in claim 1, wherein said seat has a backwardly directed surface inclined backwardly in said direction upwardly from the upper surface of said ski.

* * * * *

UNITED STATES PATENT AND TRADEMARK OFFICE

CERTIFICATE OF CORRECTION

PATENT NO. 4,128,257

DATED December 5, 1978

INVENTOR(S) Reinhold Zoor

It is certified that error appears in the above-identified patent and that said Letters Patent are hereby corrected as shown below:

Claim 1 should read:

1. A safety binding for securing a skiboot to a ski, said binding comprising means on said ski defining a primary pivot axis extending transverse to the longitudinal direction of said ski; a support plate secured to said pivot axis defining means and pivotable about said primary axis, said support plate having a forward end provided, in a plane parallel to the upper surface of the ski, with a backwardly concave seat which is assymetrical to a plane parallel to said direction and perpendicular to the upper surface of the ski; a release plate mounted on said support plate displaceable relative to the latter and having in said plane parallel to said upper surface a forwardly convex end in full engagement with said seat; a toe holder carried on said release plate adjacent said primary pivot axis; a heel holder carried on said release plate rearwardly of and aligned in said direction with said toe holder and adapted to engage over and around a heel of the skiboot; means for releasably securing said support plate to said ski in the region of said heel holder, whereby when thus secured said support plate is held in position abutting against the

UNITED STATES PATENT AND TRADEMARK OFFICE

CERTIFICATE OF CORRECTION

PATENT NO. : 4,128,257

DATED : December 5, 1978

INVENTOR(S) : Reinhold Zoor

It is certified that error appears in the above-identified patent and that said Letters Patent are hereby corrected as shown below:

upper surface of the ski and when released said support plate is free to assume a plurality of positions pivoted about said pivot axis; and release means for displacement of said release plate on said support plate and for freeing either said release plate from said support plate or said boot from between said holders in any position of said support plate on stessing at least one of said holders in a predetermined direction with a force greater than a predetermined force.

Signed and Sealed this

*Fourth* Day of *March 1980*

[SEAL]

*Attest:*

SIDNEY A. DIAMOND

*Attesting Officer*

*Commissioner of Patents and Trademarks*